US006450604B1

(12) United States Patent
Iwaishi et al.

(10) Patent No.: US 6,450,604 B1
(45) Date of Patent: Sep. 17, 2002

(54) INKJET PRINTING METHOD AND DEVICE

(75) Inventors: Akira Iwaishi, Kawasaki; Akihiko Miyaki; Takumi Kawamura, both of Inagi; Masahiro Ono, Hitachi, all of (JP)

(73) Assignee: Fujitsu Limited, Kawasaki (JP)

( * ) Notice: Subject to any disclaimer, the term of this patent is extended or adjusted under 35 U.S.C. 154(b) by 18 days.

(21) Appl. No.: 09/611,371

(22) Filed: Jul. 6, 2000

Related U.S. Application Data

(63) Continuation-in-part of application No. 09/246,705, filed on Feb. 9, 1999.

(30) Foreign Application Priority Data

Jul. 31, 1998 (JP) ..... 10-217579
Jul. 6, 1999 (JP) ..... 11-191266

(51) Int. Cl.[7] ..... B41J 29/38; B41J 29/393
(52) U.S. Cl. ..... 347/10; 347/14; 347/19
(58) Field of Search ..... 347/10, 12, 11, 347/14, 19, 86, 15, 9

(56) References Cited

U.S. PATENT DOCUMENTS 5,610,637 A * 3/1997 Sekiya et al. ..... 347/10
5,631,675 A 5/1997 Futagawa ..... 347/10
5,906,481 A 5/1999 Ogawa et al. ..... 417/413.2

FOREIGN PATENT DOCUMENTS

| | | |
|---|---|---|
| JP | 6-155732 | 6/1994 |
| JP | 7-148920 | 6/1995 |
| JP | 6-220631 | 2/1996 |
| JP | 8-85210 | 4/1996 |
| JP | 9-39244 | 2/1997 |

* cited by examiner

*Primary Examiner*—John Barlow
*Assistant Examiner*—Charles W. Stewart, Jr.
(74) *Attorney, Agent, or Firm*—Armstrong, Westerman & Hattori, LLP.

(57) ABSTRACT

An ink drop is injected via a nozzle by changing drive voltages applied to a piezoelectric element to reduce the volume of a pressure chamber filled with ink, so that the injected ink drop hits upon a print medium to carry out printing. Upon injecting the ink drop via the nozzle, an injection timing of the ink drop is changed corresponding to a drive frequency of the drive voltages using a predetermined rule. The predetermined rule may be a table defined in terms of drive frequencies of the drive voltages and optimum injection timings of the ink drop corresponding to the drive frequencies.

12 Claims, 11 Drawing Sheets

(b)

| DRIVE FREQ. (KHz) | SPEED (m/s) |
|---|---|
| 1 | 7.8 |
| 3.6 | 7.6 |
| 7.2 | 7.3 |
| 9 | 7.2 |
| 10 | 7.4 |
| 12 | 7.8 |
| 14 | 8.1 |
| 15 | 8.4 |
| 16 | 7.4 |
| 17 | 8.8 |
| 18 | 9.3 |
| 19 | 7.3 |
| 20 | 7.6 |

(a)

(b)

DRIVE VOLTAGE RATIO

| | $V_{out1}$ | $V_{out2}$ |
|---|---|---|
| WAVEFORM 1 | 0.50 | 0.50 |
| WAVEFORM 2 | 0.45 | 0.55 |
| WAVEFORM 3 | 0.40 | 0.60 |
| WAVEFORM 4 | 0.35 | 0.65 |
| ⋮ | ⋮ | ⋮ |
| WAVEFORM N | 0.05 | 0.95 |

INKJET PRINTING METHOD AND DEVICE

This is a continuation-in-part of application Ser. No. 09/246,705, filed Feb. 9, 1999, the contents of which are hereby incorporated by reference.

BACKGROUND OF THE INVENTION

1. Field of the Invention

The present invention relates to an inkjet printing method and device and, in particular, to an on-demand inkjet printing method and device for printing characters and/or images for use in a printer, a plotter, a facsimile device, a copying machine or the like.

2. Description of the Related Art

Printing devices such as printers are essential in the recent office automation environment, and even personal use printing devices have been widely spreading. Among them, with respect to the printers attention has been more paid to inkjet printers as compared with wire printers which perform printing by magnetically driving wires to press them onto a platen via an ink ribbon and print medium such as a print sheet of paper. As appreciated as compared with the wire printer, the inkjet printer produces less noise and carries out high speed printing with less printing cost per sheet.

In the inkjet printing, ink drops of different volumes or sizes are injected for forming dots if different sizes on a print medium so as to realize a halftone printing. In this case, the ink drops are jetted successively at constant periods (T|sec|).

Normally, the multi pass printing is carried out wherein ink drops of the same site are successively jetted on one line, then ink drops of another same size are successively jetted on the same line, which are repeated to jet the ink drops of various sizes without changing the line.

In the foregoing halftone printing, however, there has been a serious problem that a disorder or an output image is caused due to the fact that dots are not formed at predetermined positions on the print medium even with the normal injection timings.

Although such a disorder of the output image is prevented in the multi pass printing, there is a drawback that the printing speed is lowered.

There has also been a problem that when drive period of voltages applied to a piezoelectric element is changed, dot dislocation on a print medium occurs to lower the printing quality.

There has also been a problem at in some cases, an extra ink drop is injected to lower the printing quality.

There has also been a problem that as a time for which no ink drop is injected via a nozzle is prolonged, a hit position of on ink drop and a dot size on a print medium can not be correctly controlled.

The present inventors tried to seek reasons why the disorder of the output image is caused and found out one of the reasons that the ink drops hit upon the print medium at positions other than the predetermined positions due to differences in size of the ink drops. Specifically, when the ink drops of different sizes are injected, the fling speed increases as the volume or mass of the ink drop increases. As speed differences among the ink drops increase, the accuracy of the hit positions of the ink drops on the print medium is lowered to degrade the quality of the output image.

Another reason is also found out that since meniscus vibration after an injection of an ink drop can not be suppressed, an extra ink drop (hereinafter referred to as a "satellite drop") is injected to degrade the quality of the output image.

Another reason is also found out that as a time for which no ink drop is injected via a nozzle is prolonged, water contained in ink near a nozzle opening is gradually vaporized so that the mixing ratio of ink components as well as materiality values (viscosity, density, surface tension, etc.) are changed. Thus, for example, when the viscosity is increased, an injection ink amount is reduced to diminish a dot size on the print medium or lower an ink drop speed (average speed while ink flies as an ink drop). As a result, the hit position of the ink drop on the print medium can not be correctly controlled.

SUMMARY OF THE INVENTION

Therefore, it is an object of the present invention to provide an improved inkjet printing method that can eliminate one or more of the disadvantages inherent in the prior art.

It is another object of the present invention to provide an improved inkjet printing device that can eliminate one or more of the disadvantages inherent in the prior art.

According to a first aspect of the present invention, there is provided an inkjet printing method wherein an ink drop is injected via a nozzle by changing drive voltages applied to a piezoelectric element to reduce the volume of a pressure chamber filled with ink, so that the injected ink drop hits upon a print medium to carry out printing, the inkjet printing method comprising: changing, upon injecting the ink drop via the nozzle, an injection timing of the ink drop corresponding to a drive frequency of the drive voltages using a predetermined rule which is prestored.

It may be arranged that the prestored predetermined rule comprises a table defined in terms of drive frequencies of the drive voltages and optimum injection timings of the ink drop corresponding to the drive frequencies.

According to a second aspect of the present invention, there is provided an inkjet printing method wherein all ink drop is injected via a nozzle by changing drive voltages applied to a piezoelectric element to reduce the volume of a pressure chamber of an inkjet head filled with ink, so that the injected ink drop hits upon a print, medium to carry out printing, the inkjet printing method comprising: controlling the inkjet head upon injecting the ink drop via the nozzle such that $T3 \leqq Tc$ or $(T2 \cdot T3) \leqq Tc$, wherein T2 represents a time for rapidly contracting the pressure chamber after T1 representing a time for expanding the pressure chamber, T3 represents a time for holding the contracted state of the pressure chamber or further contracting the pressure chamber gradually, T4 represents a time for restoring the pressure chamber to an initial state, and Tc represents a period given by 1/Helmholz resonance frequency of the pressure chamber.

According to a third aspect of the present invention, there is provided on inkjet printing method wherein an ink drop is injected via a nozzle by changing drive voltages applied to a piezoelectric element to reduce the volume of a pressure chamber filled with ink, so that the injected ink drip hits upon a print medium to carry out printing, the inkjet printing method comprising: determining a waveform of the drive voltages corresponding to a flying interval of the ink drop using a predetermined rule which is prestored, the flying interval being defined as a time from an injection of an ink drop to an injection of a subsequent ink drop.

It may be arranged that the waveform of the drive voltages includes two continuous rising portions following a descend portion and having different inclinations, and wave heights of the two rising portions are defined in the prestored predetermined rule.

It may be arranged that the prestored predetermined rule comprises a table defined in terms or flying intervals of ink drops to be injected via the nozzle and optimum waveforms of drive voltages corresponding to the flying intervals.

According to a fourth aspect of the present invention, there is provided an inkjet printing device wherein an ink drop is injected via a nozzle by changing drive voltages applied lo a piezoelectric element to reduce the volume of a pressure chamber filled with ink, so that the injected ink drop hits upon a print medium to carry out printing, the inkjet printing device characterized by: changing, upon injecting the ink drop via the nozzle, an injection timing of the ink drop corresponding to a drive frequency of the drive voltages using a predetermined rule which is prestored.

It may be arranged that the prestored predetermined rule comprises a table defined in terms of drive frequencies of the drive voltages and optimum injection timings of the ink drop corresponding to the drive frequencies.

According to a fifth aspect of the present invention, there is provided an inkjet printing device wherein an ink drop is injected via a nozzle by changing drive voltages applied to a piezoelectric element to reduce the volume of a pressure chamber of an inkjet head filled with ink, so that the injected ink drop hits upon a print medium to carry out printing, the inkjet printing device characterized by: controlling the inkjet head upon injecting the ink drop via the nozzle such that $T3 \leqq Tc$ or $(T2+T3) \leqq Tc$, wherein T2 represents a time for rapidly contracting the pressure chamber after T1 representing a time for expanding the pressure chamber, T3 represents a time for holding the contracted state of the pressure chamber of further contracting the pressure chamber to an initial state, and Tc represents a period given by 1/Helmholtz resonance frequency of the pressure chamber.

According to a sixth aspect of the present invention, there is provided an inkjet printing device wherein an ink drop is injected via a nozzle by changing drive voltages applied to a piezoelectric element to reduce the volume of a pressure chamber filled with ink, so that the injected ink drop hits upon a print medium to carry out printing, the inkjet printing device characterized by: determining a waveform of the drive voltages corresponding to a flying interval of the ink drop using a predetermined rule which is prestored, the flying interval being defined as a time from an injection of an ink drop to an injection of a subsequent ink drop.

It may be arranged that the waveform of the drive voltages includes two continuous rising portions following a descending portion and having different inclinations, and wave heights of the two rising portions are defined in the prestored predetermined rule.

It may he arranged that the prestored predetermined rule comprises a table defined in terms of flying intervals of ink drops to be injected via The nozzle and optimum waveforms of drive voltages corresponding to the flying intervals.

BRIEF DESCRIPTION OF THE DRAWINGS

The present invention will be understood more fully from the detailed description given hereinbelow, taken in conjunction with the accompanying drawings.

In the drawings.

DESCRIPTION OF THE PREFERRED EMBODIMENTS

Now, preferred embodiments of the present invention will be described hereinbelow with reference to the accompanying drawings.

First Embodiment

In this embodiment, when ink drops of different sizes are injected for forming dots of different sizes on a print medium so as to realize a halftone printing an inkjet printing device ensures the accuracy of hit positions of the ink drops on the print medium, which would be otherwise lowered due to differences in size of the ink drops.

Figure 1:
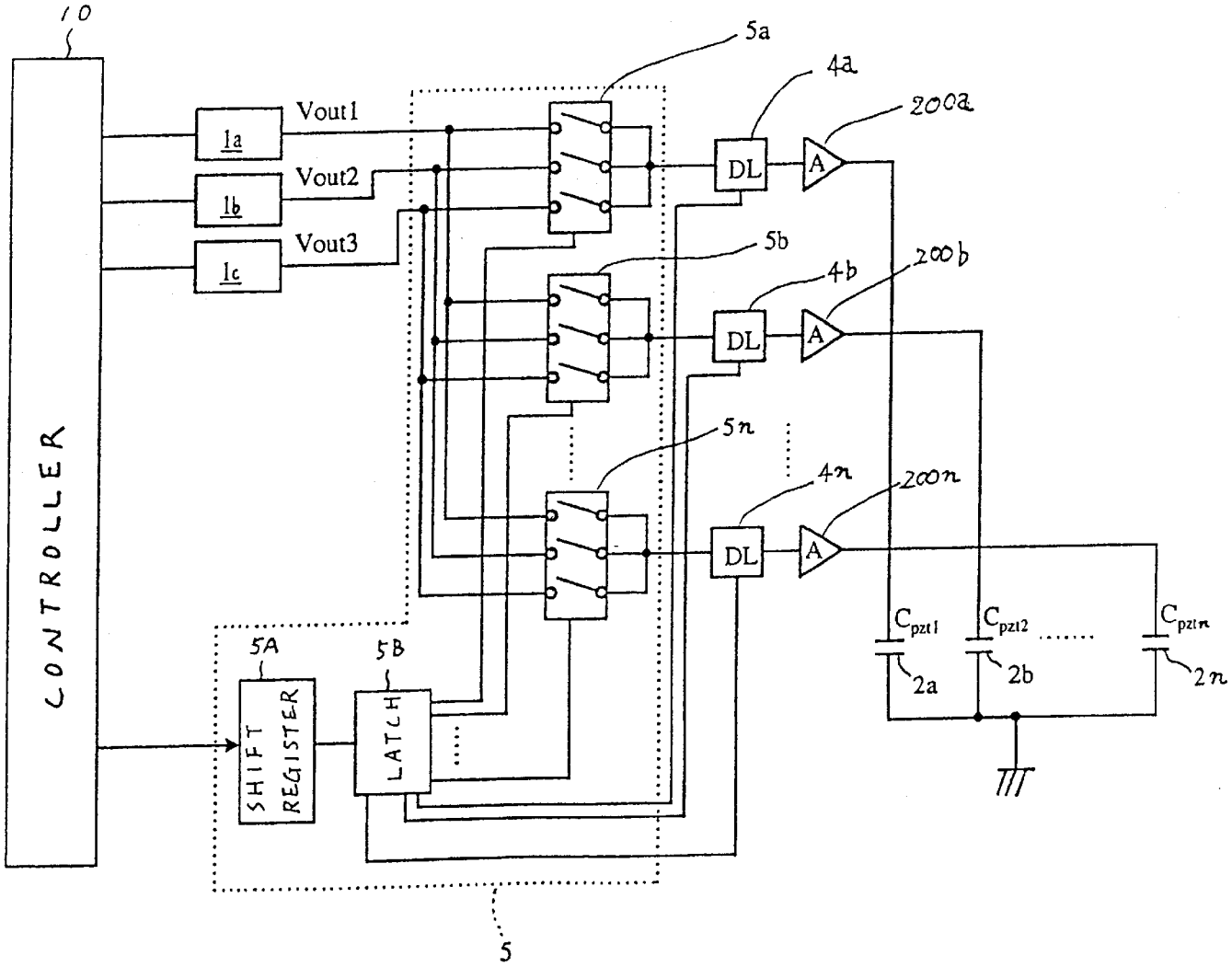
FIG. 1 is a block diagram showing a structure of a drive control circuit of an inkjet printing device according to a first preferred embodiment of the present invention.

FIG. 1 is a block diagram showing a structure of a drive control circuit of the inkjet printing device according to this embodiment.

As shown in FIG. 1, the drive control circuit comprises a controller 10 for performing a control of the whole circuit, a drive waveform feed device including circuits 1*a*, 1*b*, 1*c* for outputting drive waveforms Vout1, Vout2, Vout3, respectively, and a deform device including piezoelectric elements 2*a*, 2*b*, . . . , 2*n* which deform (expand/contract) depending on the drive waveforms Vout1, Vout2, Vout3 applied thereto. The drive control circuit further comprises a switching device 5 including switches 5*a*, 5*b*, . . . , 5*n*, a shift register 5A and a latch 5B for choosing, according to print data fed from the controller 10, the piezoelectric elements be fed with the drive waveforms. Specifically, according to a driving pattern of the piezoelectric elements 2*a*, 2*b*, . . . , 2*n* determined by the controller 10 according to the print data, the switching device 5 chooses the necessary piezoelectric elements from among the piezoelectric elements 2*a*, 2*b*, . . . , 2*n* so that each of the chosen piezoelectric elements receives corresponding one of the drive waveforms Vout1, Vout2 and Vout3.

The drive control circuit further comprises a timing adjusting device including delay circuits 4*a*, 4*b*, . . . , 4*n* for adjusting feed timings of the drive waveforms to the piezoelectric elements 2*a*, 2*b*, . . . , 2*n* depending on the amplitudes of the applied drive waveforms. The drive waveforms outputted from the delay circuits 4*a*, 4*b*, . . . , 4*n* are fed to amplifiers 200*a*, 200*b*, . . . , 200*n* where losses caused by the delay circuits are compensated, and then fed to the piezoelectric elements 2*a*, 2*b*, . . . , 2*n*.

Figure 2:
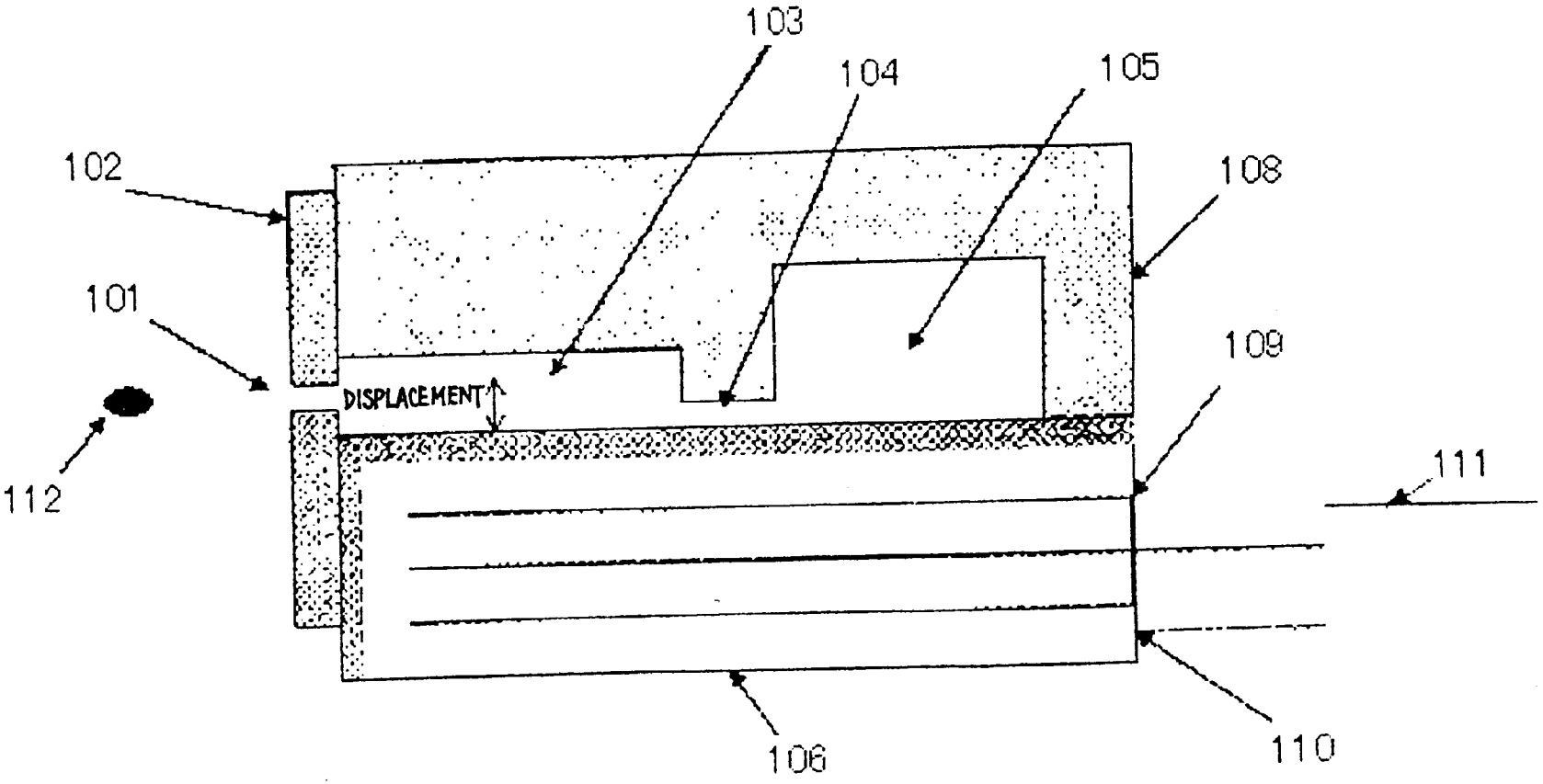
FIG. 2 is a sectional view showing a structure of one of inkjet heads of the inkjet printing device according to the first preferred embodiment of the present invention.

FIG. 2 is a sectional view showing a structure of one of inkjet heads of the ink jet printing device according to this embodiment.

As shown in FIG. 2, a space having a nuzzle opening 101 is defined by a piezoelectric element 106, a pressure chamber plate 108 nozzle plate 102. The space includes a common ink chamber 105 used by the subject and other inkjet heads, and a pressure chamber 103 dedicated for the subject ink jet head. The common ink chamber 105 acid tine pressure chamber 103 communicate with each other via a feed port 104 so that the ink in the common ink chamber 105 is fed to the pressure chamber 103 via the food port 104.

When the voltage is applied to the piezoelectric element 106 via a drive control portion 111 the pressure chamber 103 is contracted to inject an ink drop 112 via the nozzle opening 101 toward a print medium. At output from the drive control portion 111 which is fed to the piezoelectric element 106 corresponds to one of outputs from the amplifiers 200*a*, 200*b*, . . . , 200*n* shown in FIG. 1.

Referring back to FIG. 1, in this embodiment the amplitudes of the drive waveforms are inputted from the drive waveform feed circuits 1*a*, 1*b*, 1*c* into the delay circuits 4*a*, 4*b*, . . . , 4*n*, so that the feed timings of the drive waveforms to the piezoelectric elements 2*a*, 2*b*, . . . , 2*n* are adjusted according to the amplitudes of the drive waveforms. Specifically, when injecting an ink drop greater in size than a reference ink drop (in this case, an amplitude of a drive waveform for the subject ink drop is greater than that for the reference ink drop), a delay for the subject ink drop determined by the corresponding delay circuit becomes greater than a reference delay for the reference ink drop, so that the feed timing of the drive waveform for the subject ink drop to the corresponding piezoelectric element is retarded or delayed relative to an injection or drive period of the reference ink drop, that is, as compared with the feed timing of the drive waveform for the reference ink drop. On the other hand, when injecting an ink drop smaller in size than the reference ink drop (in this ease, an amplitude of a drive waveform for the subject ink drop is smaller than that for the reference ink drop), a delay for the subject ink drop determined by the corresponding delay circuit becomes smaller than the reference delay for the reference ink drop, so that the feed timing of the drive waveform for the subject ink drop to the corresponding piezoelectric element is, advanced relative period of the reference ink drop, that is, as compared with the feed timing of the drive waveform for the reference ink drop.

Figure 3:
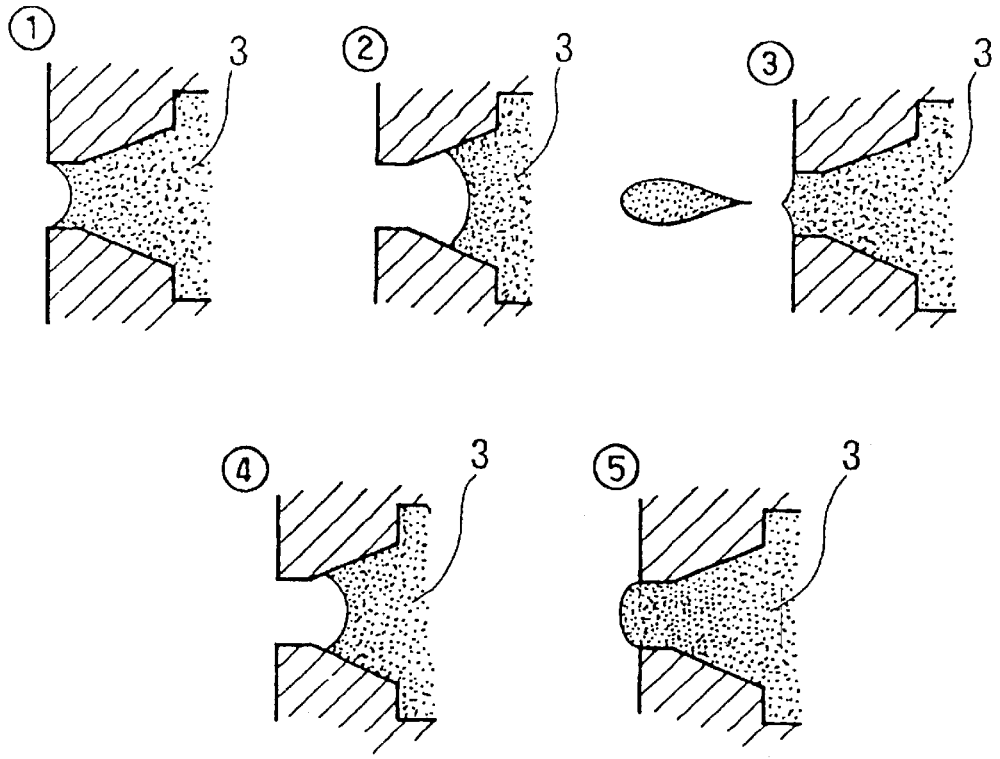
FIG. 3 is a diagram of the form of sectional views of a nozzle for explaining behavior of a meniscus of ink when an ink drop is injected using the inkjet printing device according to the first preferred embodiment of the present invention.

FIG. 3 is diagram in the form of sectional views of a nozzle for explaining behavior of a meniscus of ink when an ink drop is injected using the inkjet printing device according to this embodiment.

Figure 4:
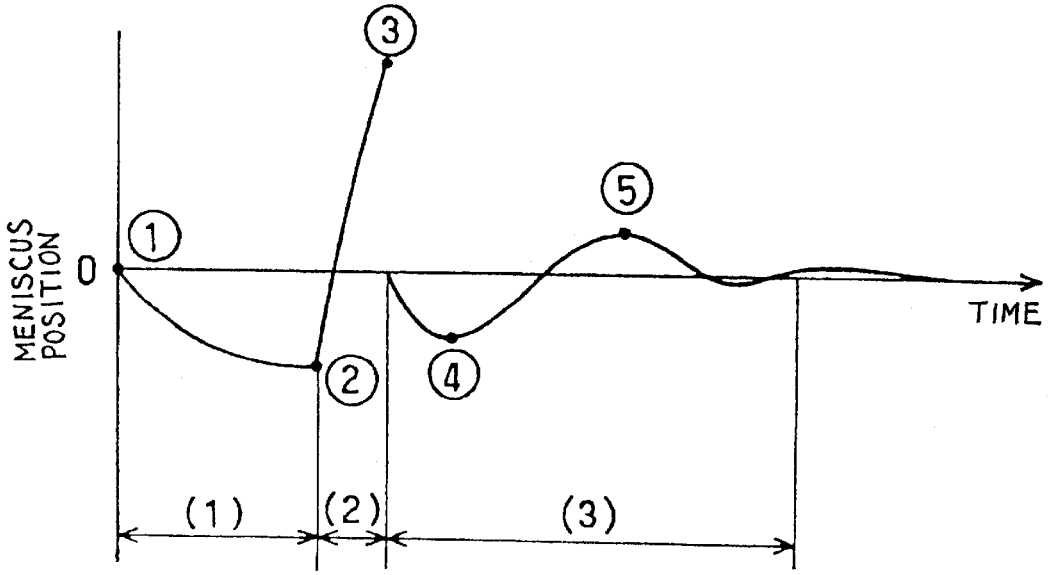
FIG. 4 is time chart, showing a positional variation of the meniscus in the inkjet printing device according to the first preferred embodiment of the present invention.

FIG. 4 is a time chart showing a positional variation of the meniscus in the inkjet printing device according to this embodiment.

Now, behavior of the meniscus of the ink upon injection of an ink drop using the inkjet printing device according to this embodiment will be explained with reference to FIGS. 3 and 4.

① in FIGS. 3 and 4

The meniscus is at default position.

② in FIGS. 3 and 4

Voltage of the drive waveform applied to the piezoelectric element is lowered to reduce the pressure in the pressure chamber 3, so that the meniscus retreats.

③ in FIGS. 3 and 4

Voltage of the drive waveform applied to the piezoelectric element is sharply raised to cause a sudden increase of the pressure in the pressure chamber 3, so that an ink drop is injected. A changing point H (see FIG. 5) where the voltage changes front decreasing to increasing represents an injection turning.

④ and ⑤ in FIGS. 3 and 4

The meniscus vibrates due to residual energy.

Assuming that a resolution is represented by x [dpi] and a throughput speed of a printhead is represented by speed

[mm/sec], a relation thereof with a drive frequency f [kHz] and a drive period KT (−1/f) |sec| is given by $$\{25.4\ [\mathrm{mm}]/x[\mathrm{dpi}]\}/\mathrm{speed}[\mathrm{mm/sec}]=KT(=1/l)[\mathrm{sec}] \quad (1)$$

Accordingly, a time between injection timings represents a time interval between dots on print medium when reference ink drops are successively injected per drive period KT |sec|. When the number of kinds of ink drops to be jetted is an odd number, the reference ink drop is defined as one of them having the middle size. On the other hand, when the number is an even number, the reference ink drop is defined as one of them which is set to have the same speed difference relative to the minimum and maximum ink drops.

It is assumed that three kinds of ink drops, that is, big, middle and small ink drops, are injected and that the middle ink drop is set to be a reference ink drop. In this case, assuming that initial injection speeds of the big, middle and small ink drops are v1, v_def and v3 |m/s[1] (vl>v def>v3), respectively, the big ink drop hits upon the print medium time_1 |sec| earlier than the middle ink drop, while the small ink drop hits upon the print medium time_3 [sec] later than the middle ink drop. Thus, hit positions of the big and small ink drops on the print medium are deviated or dislocated correspondingly relative to a hit position of the middle, i.e. reference, ink drop.

The foregoing time_[sec] is given by $$\mathrm{time_}\mathbf{1}=Lx|(1/v\mathbf{1})-(1/v_\mathrm{def})| \quad (2)$$

wherein time_1 represents a hit little difference |sec|, L represents a distance [mm] from a tip of the nozzle to the print medium, and v1 and v def represent the initial injection speeds [m/s] of the big and middle ink drops respectively.

The foregoing time_3 [sec] is given by $$\mathrm{time_}3-Lx|(1/v\mathbf{3})-(1/v_\mathrm{def})| \quad (3)$$

wherein time_3 represents a hit time difference [sec], L represents the distance |mm| from the tip of the nozzle to the print medium, and v3 and v_def represent the initial injection speeds [m/s] of the small and middle ink drops, respectively.

Accordingly, when jetting the big ink drop having a flying speed higher than that of the middle ink drop, the injection timing thereof is delayed by time_1 [sec] relative to the injection timing determined by the drive period KT [sec]. On the other hand, when jetting the small ink drop having a flying speed lower than that of the middle ink drop, the injection timing thereof is advanced by time_3 [sec] relative to the injection timing determined by the drive period KT [sec]. This cancels an influence caused by difference in speed of the ink drops having different sizes so as to prevent dislocation of the corresponding dots on the print medium.

Figure 5:
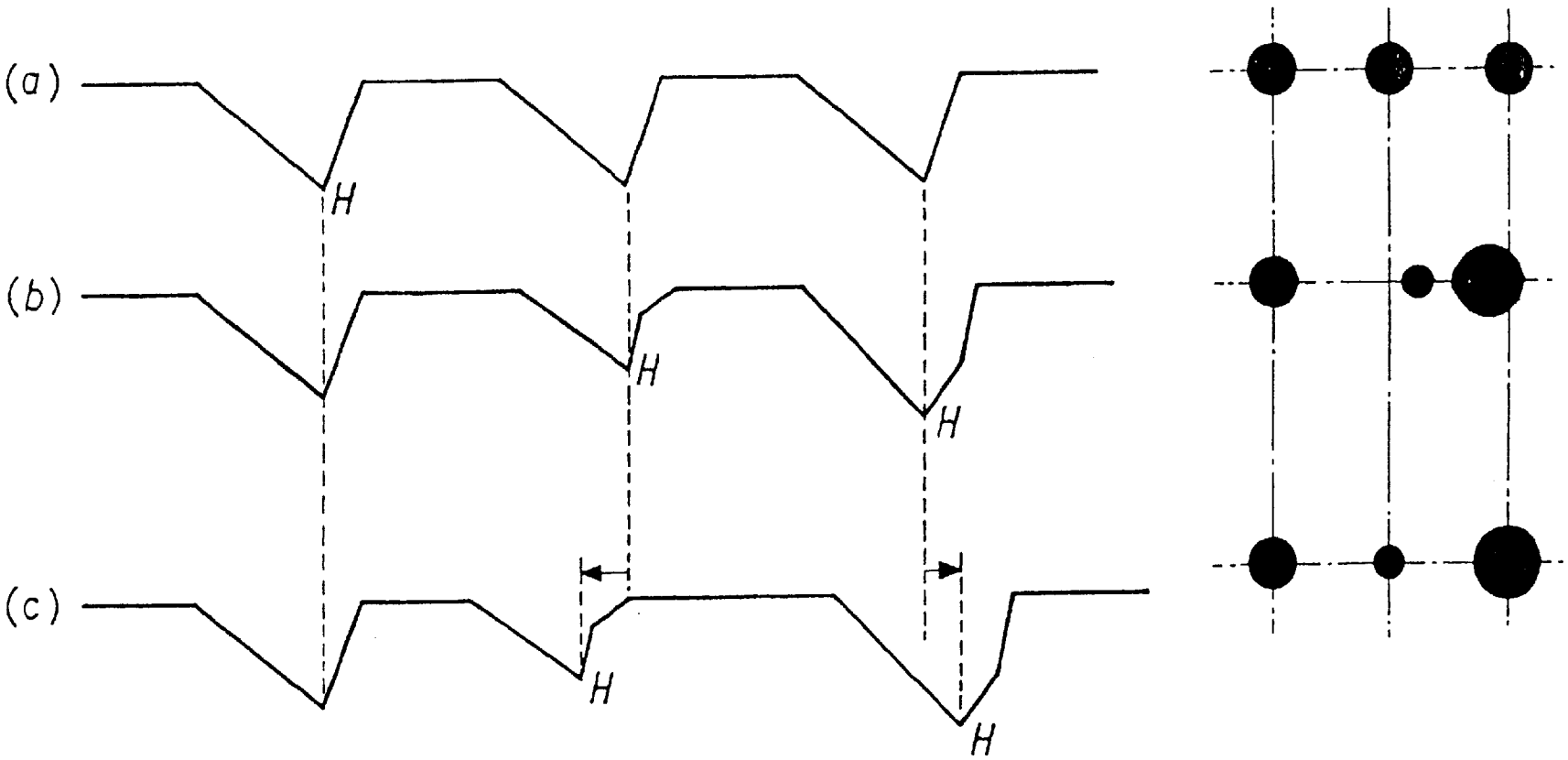
FIG. 5 is a diagram for explaining a relationship between a time chart of drive waveforms fed to a piezoelectric element for injecting ink drops, and corresponding hit positions of the ink drops on a print medium, wherein (a) shows the drive waveforms when middle ink drops are injected per drive period RT and the resultant dots on the print medium, (b) shows the waveforms when middle, small and big ink drops are injected per drive period KT, and the resultant dots on the print medium, which corresponds to the prior art, and (c) shows the waveforms the middle, small and big ink drops are injected according to the first preferred embodiment of the present invention, and the resultant dots on the print medium.

FIG. 5 shows a relationship between a time chart of the drive waveforms fed to the piezoelectric element and the corresponding hit positions of the ink drops on the print medium when the big, middle and small ink drops are jetted. In FIG. 5, (a) shows the waveforms when the middle ink drops are injected per drive period KT, and the resultant dots on the print medium, (b) shows the waveforms when the middle, small and big ink drops are injected per drive period KT, and the resultant dots on the print medium, which corresponds to the prior art, and (c) shows the waveforms when the middle, small and big ink drops are injected according to this embodiment and the resultant dots on the print medium.

As seen from FIG. 5, when only the middle ink drops are jetted, since all the time drops have the same size the ink drops precisely hit upon the print medium at given positions. On the other hand, when the three kinds of ink drops, that is, the big, middle and small ink drops, are jetted at the constant drive periods KT as in the prior art, the small ink drop having a lower flying space hits Upon the print medium after time given position, while the big ink drop hits upon the pint medium before the given position. In contrast, according to this embodiment the injection timing of the big ink drop is delayed relative to the injection timing determined by the drive period KT while the injection timing of the small ink drop is advanced relative to the injection timing determined by the drive period KT while the injection timing of the small ink drop is advanced relative to the injection timing determined by the drive period KT, so that all the ink drops hit upon the print medium precisely at the given positions.

Second Embodiment

In this embodiment, when ink drops of a given size are injected for forming dots on a print medium, an inkjet printing device ensures the accuracy of hit positions of the ink drops on the print medium, which would be otherwise lowered due to differences in drive period of drive voltages applied to an inkjet head.

In this embodiment, a structure of a drive control circuit of the inkjet printing device is the same as that of the first preferred embodiment shown in FIG. 1.

Similarly, in this embodiment, a structure of each of inkjet heads of the inkjet printing device is the same as that of the first preferred embodiment shown in FIG. 2.

On the other hand, the controller 10 in this embodiment executes a control which is independent of the first preferred embodiment and later-described third and fourth preferred embodiments of the present invention, but may also be executed in those other preferred embodiments.

Figure 6:
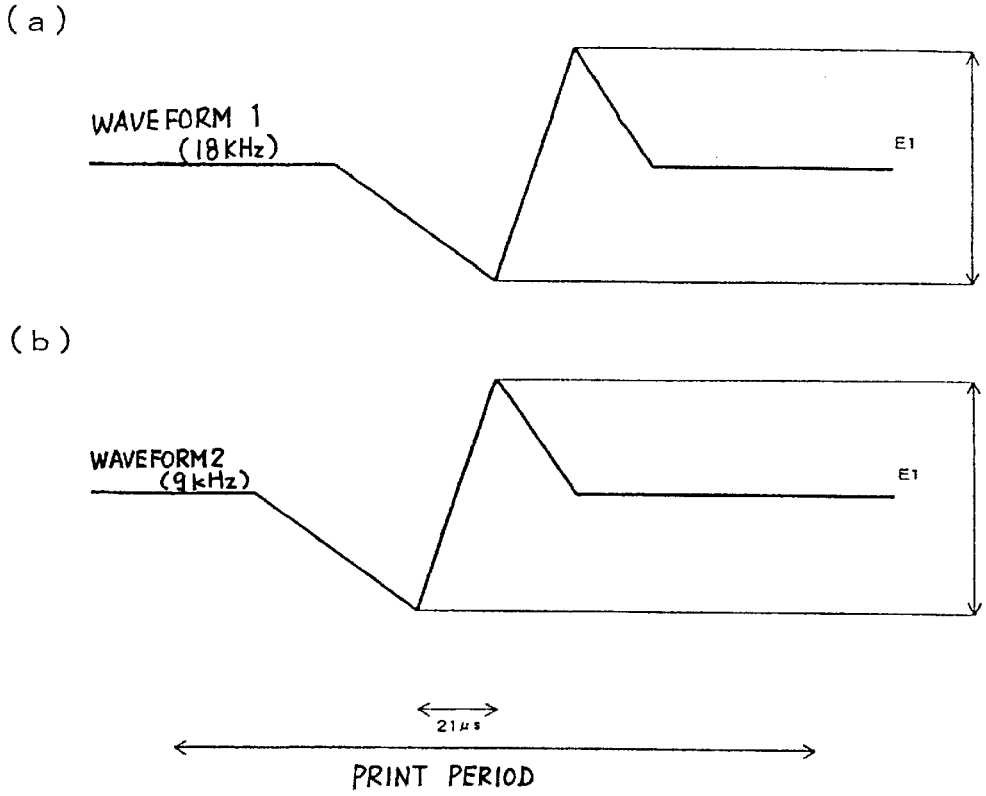
FIG. 6 is a diagram showing two examples of drive waveforms corresponding to different drive periods of an inkjet head of an inkjet printing device according to a second preferred embodiment of the present invention wherein shows a drive waveform where a drive frequency is 18 kHz, and (b) shows a drive waveform where a drive frequency is 9 kHz.

FIG. 6 shows two examples of drive waveforms corresponding to different drive periods of an inkjet head of the inkjet printing device according to this embodiment.

In general, it is necessary to frequently change a drive period of drive voltages required for driving an inkjet bead even during printing one character. This change in drive period is required in response to a change in the form of a character to he printed and in dot position on a print medium, and thus can not be avoided.

In FIG. 6, (a) shows as Waveform 1 a drive waveform where a drive frequency is 18 kHz and (b) shows as Waveform 2 a drive waveform where a drive frequency is 9 kHz.

When comparing Waveform 1 and Waveform 2 both are equal to each other as a waveform itself but differ from each other in that Waveform 2 advances in phase by 21 $\mu$s relative to Waveform 1. Specifically, a time point of applying the drive voltages for generating Waveform is earlier than that for Waveform 1 by 21 $\mu$s. However, these voltage applying time points are both correct voltage applying time points corresponding to the drive periods of Waveforms 1 and 2.

Figure 7:
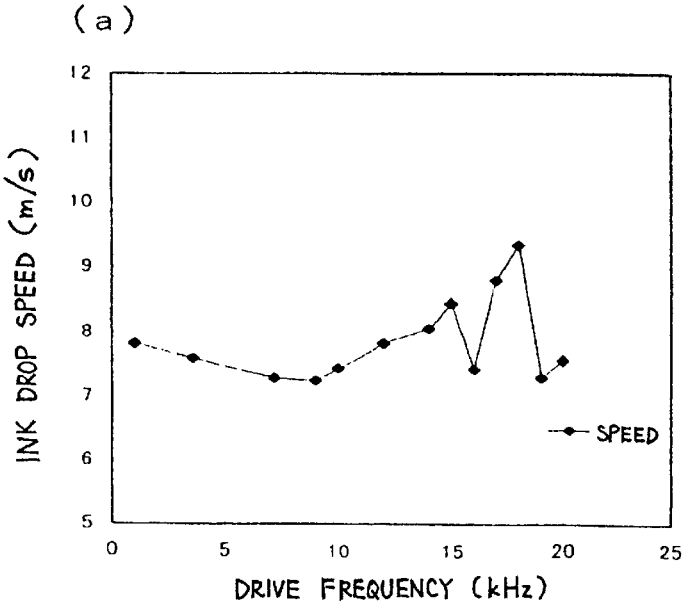
FIG. 7 is a diagram, wherein (a) and (b) are a graph and a table, respectively showing a relationship between drive frequencies of an inkjet head of the inkjet printing device and ink drop speeds according to the second preferred embodiment of the present invention.

In FIG. 7, (a) and (b) are a graph and a table, respectively, showing a relationship between drive frequencies (periods) of an inkjet head of the inkjet printing device and ink drop speeds according to this embodiment.

In this is embodiment, in consideration of the relationship between the drive periods of an inkjet head and the ink drop speeds as shown in FIG. 7, the controller 10 controls the output timings of the circuits 1*a*, 1*b*, 1*c* (drive waveform feed device) so that ink drops corresponding to the respective drive periods hit upon the print, medium at correct positions, i.e. without causing dislocation of dots on the print medium.

As seen from (a) in FIG. 7, the relationship between the drive frequencies and the ink drop speeds is not a simple proportional relationship. However, for example, the table shown at (b) in FIG. 7, which is prepared in terms of the drive frequencies and the corresponding ink drop speeds, may be prestored in the controller 10 so that the controller 10 can achieve a control or feeding the optimum injection timings to the respective inkjet heads based on the complicated relationship between the drive frequencies and the corresponding ink drop speeds as shown at (a) in FIG. 7.

It may also be possible that a table, which is prepared more directly in terms of the drive frequencies and the corresponding optimum injection timings, may he prestored it the controller 10, other than the foregoing table as shown at (b) in FIG. 7.

Third Embodiment

In this embodiment, during a process of injecting an ink drop of a given size, an inkjet printing device prevents living of a satellite drop which would be otherwise caused by meniscus vibration after an injection of the ink drop.

Figure 8:
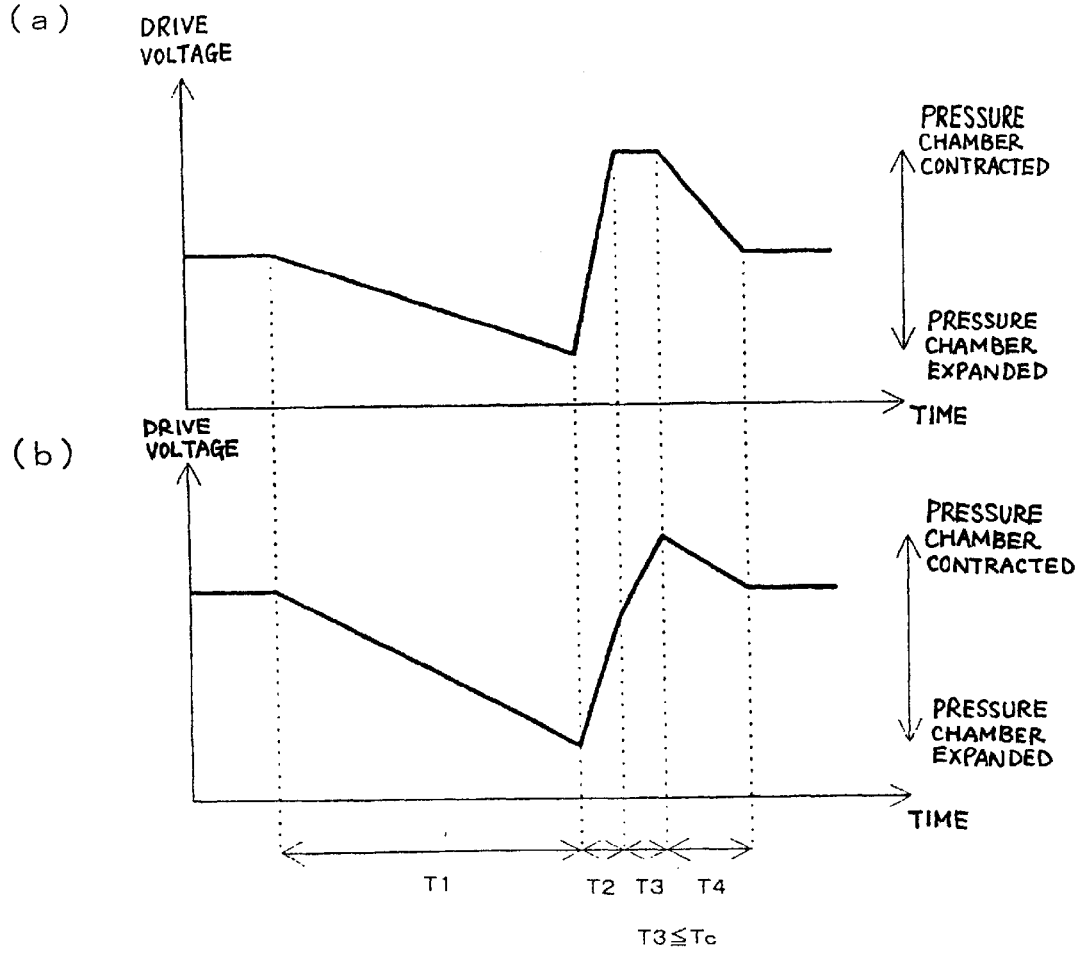
FIG. 8 is a diagram showing waveforms of drive voltages applied to piezoelectric element of an inkjet printing device according to a third preferred embodiment of the present invention.

FIG. 8 is a diagram showing waveforms of drive voltages applied to a piezoelectric element of the inkjet printing device according to this embodiment.

In this embodiment, a structure of a drive control circuit of the inkier printing device is the same as that of the first preferred embodiment shown in FIG. 1.

Similarly, in this embodiment, a structure of each of inkjet heads of the inkjet printing device is the same as that of the first preferred embodiment shown in FIG. 2.

On the other hand, the controller 10 in this embodiment executes a control which is independent of the first and second preferred embodiments and the later-described fourth preferred embodiment of the present invention, but may also be executed in those other preferred embodiments.

In FIG. 8, T1, T2, T3, T4 and Tc are defined as follows:

T1: time for expanding the pressure chamber 103;

T2: time for rapidly contracting the pressure chamber 103;

T3: time for holding the contracted state of the pressure chamber 103 or further contracting the pressure chamber 103 gradually;

T4: time for restoring the pressure chamber 103 to the initial state; and Tc: period given by 1/Helmholtz resonance frequency of the pressure chamber 103.

Now, referring to FIGS. 1, 2 and 8, an operation of one of the inkjet heads of the inkjet printing device according to this embodiment will be described.

For example, the controller 10 shown in FIG. 1 applies drive voltages to the piezoelectric element 106 of the inkjet head shown in FIG. 2 for time T1 according to the waveform shown at (a) or (b) in FIG. 8. Thus, the piezoelectric element 106 contracts, and accordingly, the pressure chamber 103 expands for time T1. As a result, the meniscus retreats into the nozzle opening 101, and simultaneously, the ink in the common ink chamber 105 is conducted into the pressure chamber 103 via the feed port 104.

Then, the controller 10 applies drive voltages to the piezoelectric element 106 for time T2 according to the waveform shown at (a) or (b) in FIG. 8. Thus, the piezoelectric element 106 expands thereby to contract the pressure chamber 103. As a result an ink drop is injected via the nozzle opening 101.

Then, the controller 10 applies drive voltages to the piezoelectric element 106 for time T3 according to the waveform shown at (a) or (b) in FIG. 8 Thus, the volume of the pressure chamber 103 is held unchanged for time T3 or gradually reduced lore time T3.

Then, the controller 10 applies drive voltages to the piezoelectric element 106 for time T1 according to the waveform shown at (a) or (b) in FIG. 8. Thus, the volume of the pressure chamber 103 is restored to the initial state after a lapse of time T4.

During the foregoing operation, the controller 10 controls a time relationship to be $T3 \leqq Tc$ or $(T2+T3) \leqq Tc$.

Specifically, the T3 portion of the waveform is for transition to the T4 portion to stop the movement, of the piezoelectric element or gradually expand the piezoelectric element for enhancing an effect achieved by the T4 portion.

The contraction of the piezoelectric element at the T4 portion is for expanding the pressure chamber 103 thereby to retreat the meniscus into :he nozzle opening 101 for the purpose of preventing flying of satellite drop which would be otherwise cause by meniscus vibration after an injection of an ink drop.

Since the timing to start the T4 portion should be before flying of a satellite drop via the nuzzle opening 101 occurs due to the meniscus displacement (see FIG. 9) caused by the meniscus vibration, the controller 10 controls the time relationship to be $T3<Tc$ or $(T2|T3) \leqq Tc$ as described above.

Figure 9:
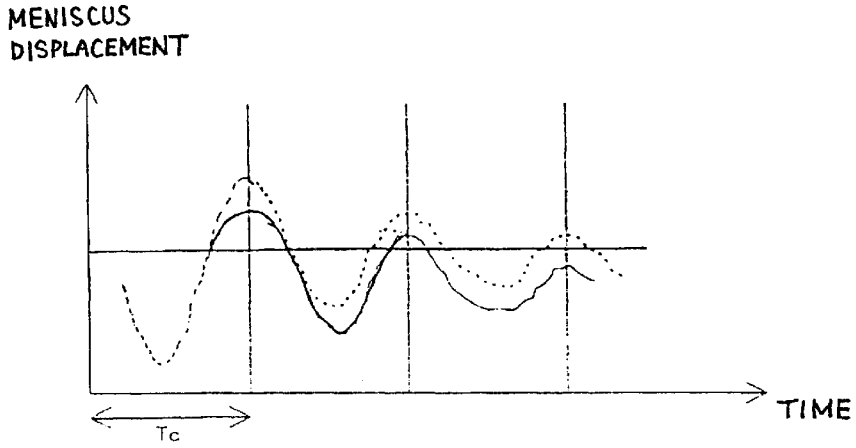
FIG. 9 is a waveform diagram showing a relationship between a meniscus displacement and a drive voltage applying time in the inkjet printing device according to the third preferred embodiment of the present invention.

FIG. 9 is a waveform diagram showing a relationship between a meniscus displacement and a drive voltage applying time in the inkjet printing device according to this embodiment.

In FIG. 9, a broken line waveform represents the conventional meniscus displacement, while a solid line waveform represents the meniscus displacement according to this embodiment wherein the foregoing control is carried out. Since the meniscus vibration after an injection of an ink drop is suppressed as shown by the solid line waveform in FIG. 9, flying of a satellite drop is prevented.

As appreciated the waveforms shown in FIGS. 8 and 9 are only examples, and other waveforms may be used instead of them.

Fourth Embodiment

In this embodiment, an inkjet printing device prevents a disorder of an output image, which would be otherwise caused by reduction in size of a dot formed on a print medium due to an influence of a sticky material formed at a nozzle opening of an inkjet head or by reduction in ink drop speed (average speed while ink flies as an ink drop) due to such a sticky material.

Figure 10:
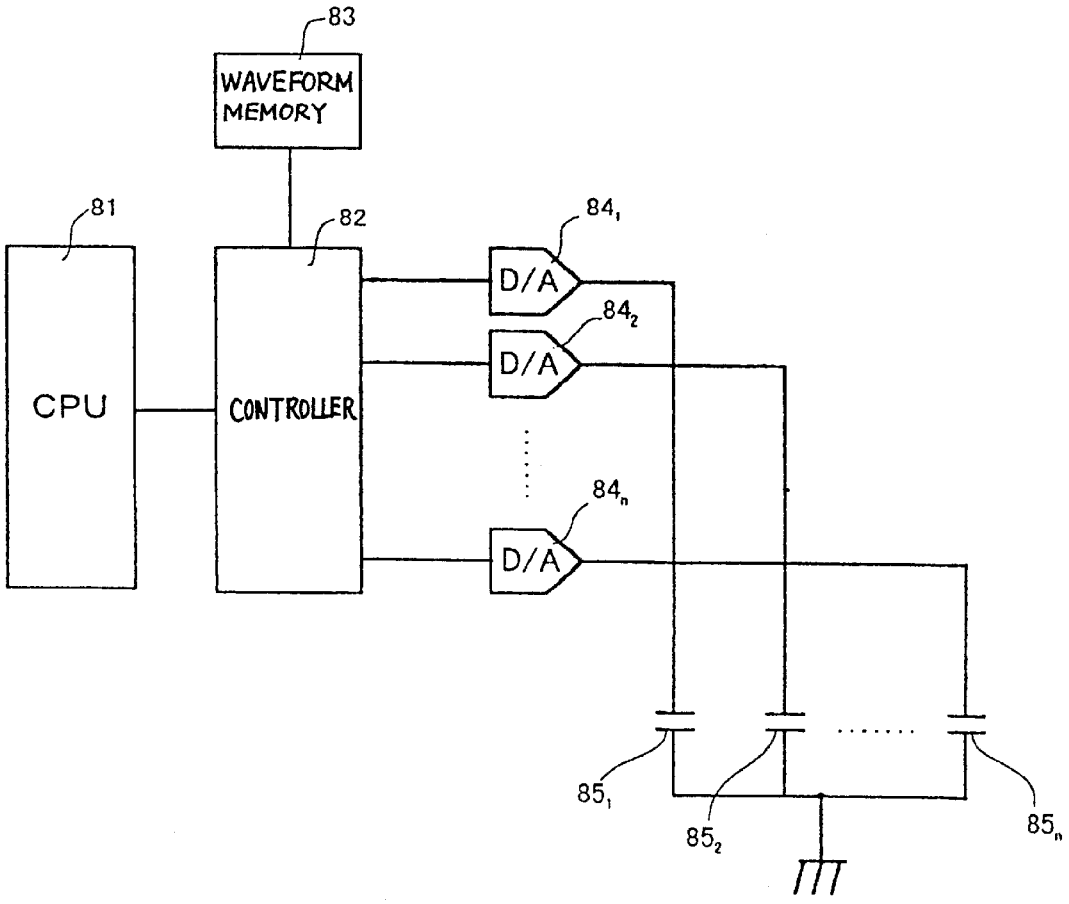
FIG. 10 is a block diagram showing the whole structure of a drive control circuit of an inkjet printing device according to a fourth preferred embodiment of the present invention.

FIG. 10 is a block diagram showing the whole structure of a drive control circuit of the inkjet printing device according to this embodiment.

The drive control circuit in this embodiment comprises a controlled 82 for performing a control of the whole circuit. D/A converters $\mathbf{84}_1$, $\mathbf{85}_2$, . . . , $\mathbf{84}_n$ each for converting a digital signal outputted from the controller 82 into an analog voltage signal, piezoelectric elements $\mathbf{85}_1$, $\mathbf{85}_2$, . . . , $\mathbf{85}_n$ driven by analog voltage signals fed from the corresponding D/A converters $\mathbf{84}_1$, $\mathbf{84}_2$, . . . , $\mathbf{84}_n$, a waveform invention 83 storing waveforms of the analog voltage signals to be applied to the piezoelectric elements $\mathbf{85}_1$, $\mathbf{85}_2$, . . . , $\mathbf{85}_n$ and feeding them to the controller 82, and a CPU 81 for feeding a command to the controller 82 about a control to be executed.

In this embodiment, a structure of each of inkjet heads of the inkjet printing device is same that of the first preferred embodiment shown in FIG. 2.

Output lines of the D/A converters $\mathbf{84}_1$, $\mathbf{84}_2$, . . . , $\mathbf{84}_n$ correspond to output lines of the drive control portion 111 shown in FIG. 2.

A control executed by the controller 82 of the inkjet printing device in this embodiment may also be executed in the foregoing first to third preferred embodiments.

Figure 11:
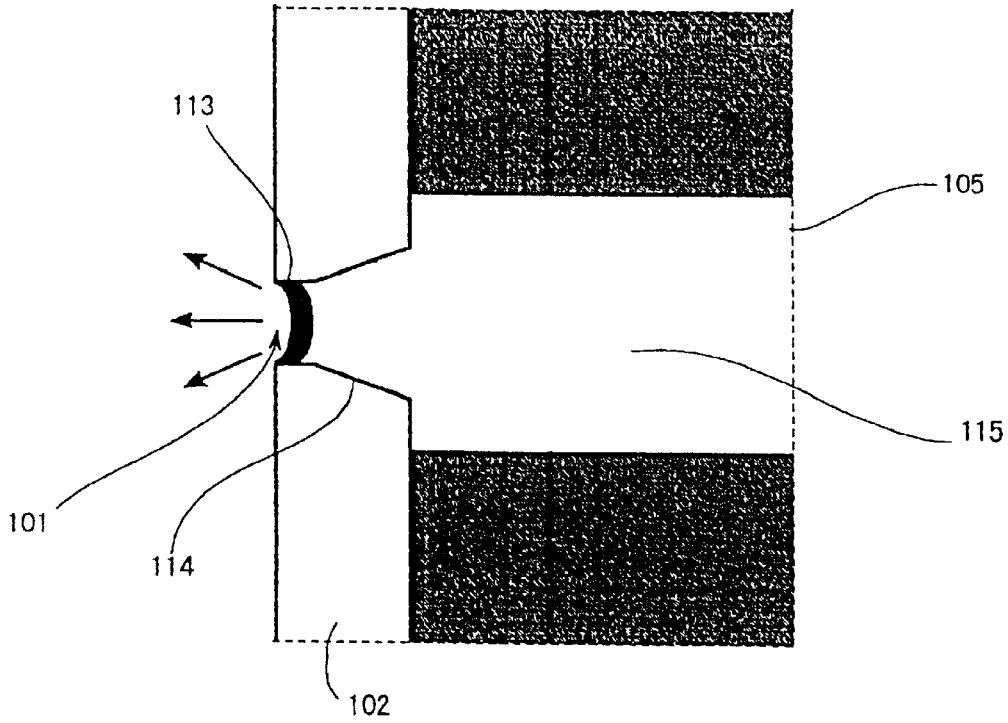
FIG. 11 is a sectional view showing a structure of one of inkjet heads of the inkjet printing device At a portion around a nozzle opening.

FIG. 11 is a sectional view showing a structure of one of inkjet heads of the inkjet printing device at a portion around a nozzle opening.

In FIG. 11, a common ink chamber 105 is filled with ink 115 which is injected via a nozzle opening 101 of a nozzle 114 to the exterior as an ink drop.

A sticky material 113 remains after vaporization of the ink and adheres to the nozzle opening 101. After an ink drop is injected to the exterior, water contained in the ink is vaporized before a subsequent ink drop is injected to the exterior. The sticky material 113 is formed during this vaporization. Specifically, during the vaporization, the ink adhering to the nozzle opening 101 changes in mixing ratio of ink components and materiality values (viscosity, density, surface tension, etc. The sticky material 113 exists in the process of such changes.

Due to the existence of the sticky material 113, the ink drop speed, i.e. the average speed while the ink flies as an ink drop, is affected, and in general, is lowered as compared with the expected average speed.

Figure 12:
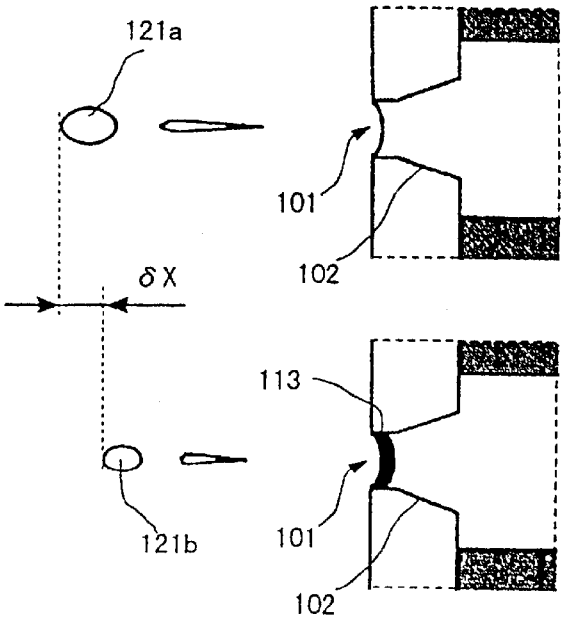
FIG. 12 is a diagram for explaining a variation in speed of inkjet drops via a nozzle opening of one of the inkjet heads of the inkjet printing device.

FIG. 12 is a diagram for explaining a variation in speed of ink drops injected via a nozzle opening of one of the ink jet heads of the inkjet printing device.

When the sticky material 113 adheres in the nozzle opening 101, the volume of an ink drop 121*b* is reduced as compared with that of an ink drop 121*a*. Accordingly, for the reason explained in the foregoing first preferred embodiment, the ink drop speed of the ink drop 121*b* is lowered by, for example, ox as shown in FIG. 12 as compared with the ink drop speed of the ink drop 121*a* where no sticky material is attached to the nozzle opening 101.

The lowering of the ink drop speed device dislocation of a hit position of an ink drop relative to a correct hit position on the print medium.

As a result, the existence of the sticky material 113 causes an insufficient dot size on the print medium and dislocation of a hit position on the print medium. The degree or dot size insufficiency or hit position dislocation becomes greater as a time from an injection of an ink drop to an injection of a subsequent ink drop becomes longer, and finally exceeds an allowable range.

Figure 13:
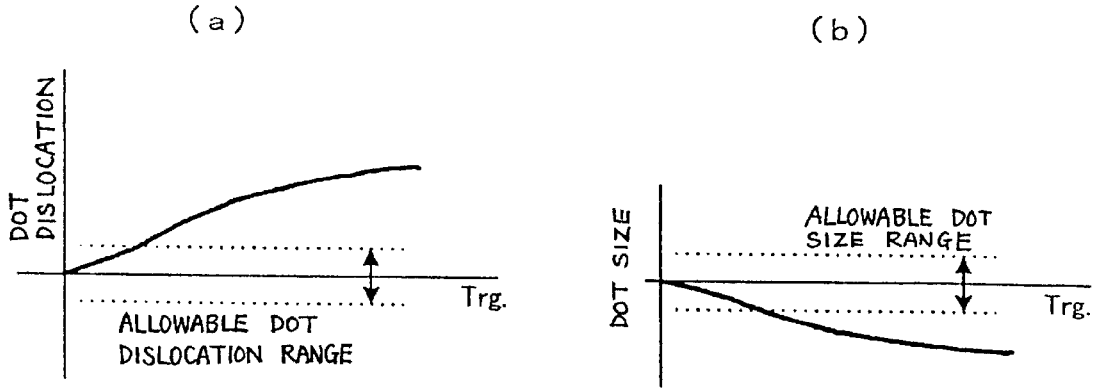
FIG. 13 PRIOR ART
FIG. 13 is a diagram showing a relationship between ink drop flying intervals (Trg.) and ink drop hit positions on a print medium according to the prior art, and further showing a relationship between ink drop flying intervals (Trg.) and ink dot sizes on the print medium according to the prior art.

In FIG. 13, (a) is a graph showing a relationship between ink drop flying intervals (Trg.) and ink drop hit positions on the print medium according to the prior art, wherein a region defined by broken lines represents an allowable clot dislocation range, and (b) is a graph showing a relationship between ink drop flying intervals (Trg.) and ink dot sizes on the print medium according to the prior art, wherein a region defined by broken lines represents an allowable dot size range.

As shown in FIG. 13, as an ink drop flying interval (Trg.), i.e. a time from an injection of an ink drop to an injection of a subsequent ink drop, is prolonged, the degrees of ink dot dislocation on the print medium and dot size variation on the print medium are increased to finally exceed the respective allowable ranges.

However, these drawbacks can be solved by changing a waveform of the foregoing analog voltage signal applied to each of the piezoelectric elements $\mathbf{85}_1$, $\mathbf{85}_2$, . . . , $\mathbf{85}_n$.

Figure 14:
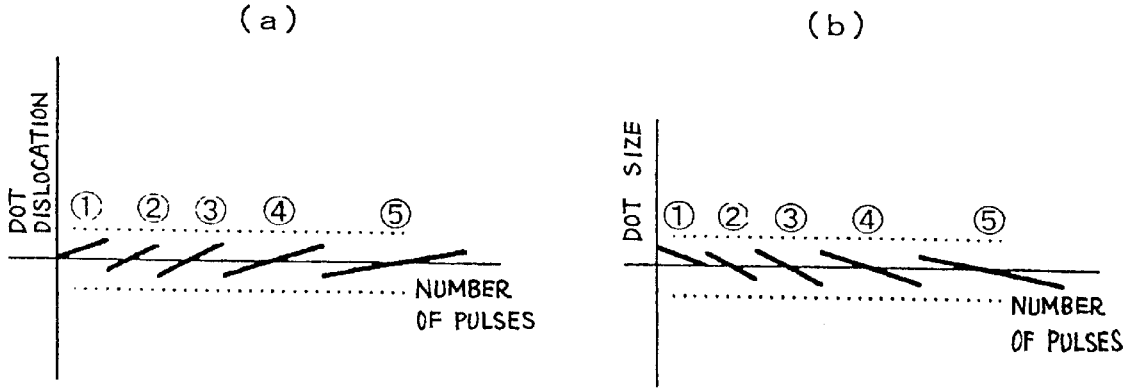
FIG. 14 is a diagram showing that ink dot positions and ink dot sizes on the print medium can be controlled to fall within respective allowable ranges by changing a waveform of a voltage signal applied to a piezoelectric element of the ink jet printing device corresponding to increment of the ink drop flying interval (Trg.) according to the fourth preferred embodiment of the present invention.

FIG. 14 is a diagram showing that ink dot positions and ink dot sizes on the print medium can he controlled to fall within the respective allowable ranges by changing a waveform of the voltage signal applied to the piezoelectric element of the inkjet printing device corresponding to increment of the ink drop flying interval (Trg.).

In FIG. 14, ① to ⑤ represent the numbers of pulses discontinuously inputted to the piezoelectric element, and these numbers of pulses correspond to increment of the ink drop flying interval (Trg.).

Pulse waveforms shown corresponding to the foregoing numbers of pulses represent voltage waveforms applied to the piezoelectric element, which will be described later in detail. FIG. 14 is an explanatory diagram for showing that the pulse waveform is changed corresponding to increment of the ink drop flying interval (Trg.).

As appreciated, in FIG. 14, regions defined by broken lines represent the allowable dot dislocation and dot size ranges, respectively. Thus, FIG. 14 shows the slates at (a) and (b) wherein the ink dot positions and sizes are successfully controlled to be within the respective allowable ranges corresponding to the respective numbers ① to ⑤.

Specifically, in this embodiment, the ink drop flying interval (Trg.) is monitored per nozzle and upon injecting an ink drop via each nozzle, a voltage pulse signal of a given waveform corresponding to the ink drop flying interval (Trg.) of the associated nozzle is applied to piezoelectric element of the associated nozzle.

More specifically, the waveform of the voltage pulse signal is changed corresponding w the ink drop flying interval (Trg.) of the associated nozzle using a predetermined rule. In other words, the waveform of the voltage pulse signal is selected from among prestored waveforms corresponding to the ink drop living interval (Trg.) of the associated nozzle. This selection is carried out by the CPU 81 shown in FIG. 10.

Figure 15:
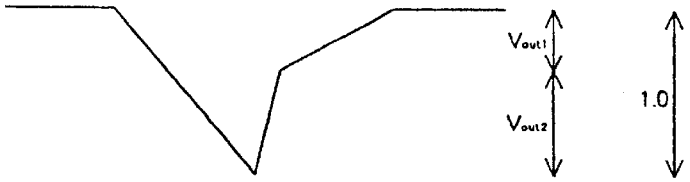
FIG. 15 is a diagram showing waveforms of a voltage pulse signal applied to a piezoelectric element of the inkjet printing device according to the fourth preferred embodiment of the present invention, wherein (a) is graph showing a typical waveform of the voltage pulse signal applied to the piezoelectric element, and (b) is a table representing various waveforms of the voltage pulse signal applied to the piezoelectric element in terms of ratios of heights of main portions of the waveform shown at (a) in FIG. 15.

FIG. 15 is a diagram showing waveforms of a voltage pulse signal applied to a piezoelectric element of the inkjet printing device according to this embodiment, wherein (a) is a graph showing a typical waveform of the voltage pulse signal applied to the piezoelectric element, and (b) is a label representing various waveforms of the voltage pulse signal applied to the piezoelectric element in terms of ratios of heights of main portions of the waveform shown at (a) in FIG. 15.

As shown in FIG. 15, the waveform of the drive voltage signal includes two continuous rising portions following a descending portion. These two rising portions have different inclinations, and the wave heights of these two rising portions are determined corresponding to the flying interval of an ink drop to be injected via the nozzle The foregoing predetermined rule, i.e. relationships between the ink drop fling intervals (Trg.) and the corresponding waveforms of the drive voltage signal, may be provided in the form of a table, e.g. a computer readable table.

Figure 16:
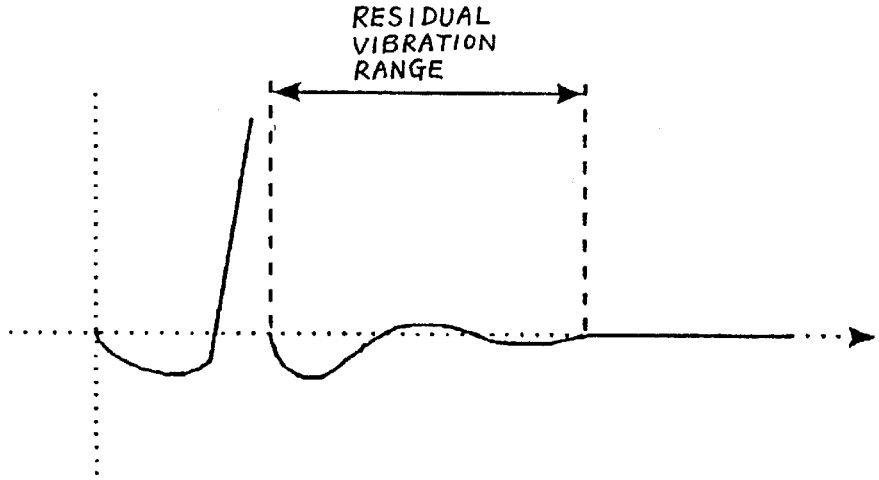
FIG. 16 is a diagram for explaining residual vibration of an inkjet head of the inkjet printing device.

The ink drop flying interval (Trg.) is measured per nozzle, and to be exact, should be measured excluding a flying time of a remainder of an ink drop caused residual vibration shown in FIG. 16 of the inkjet head shown in FIG. 2. Such a measuring function may be provided in the form of firmware.

In this embodiment, the ink drop flying internal (Trg.) is measured excluding time of residual vibration of the ink jet head as shown in FIG. 16.

Figure 17:
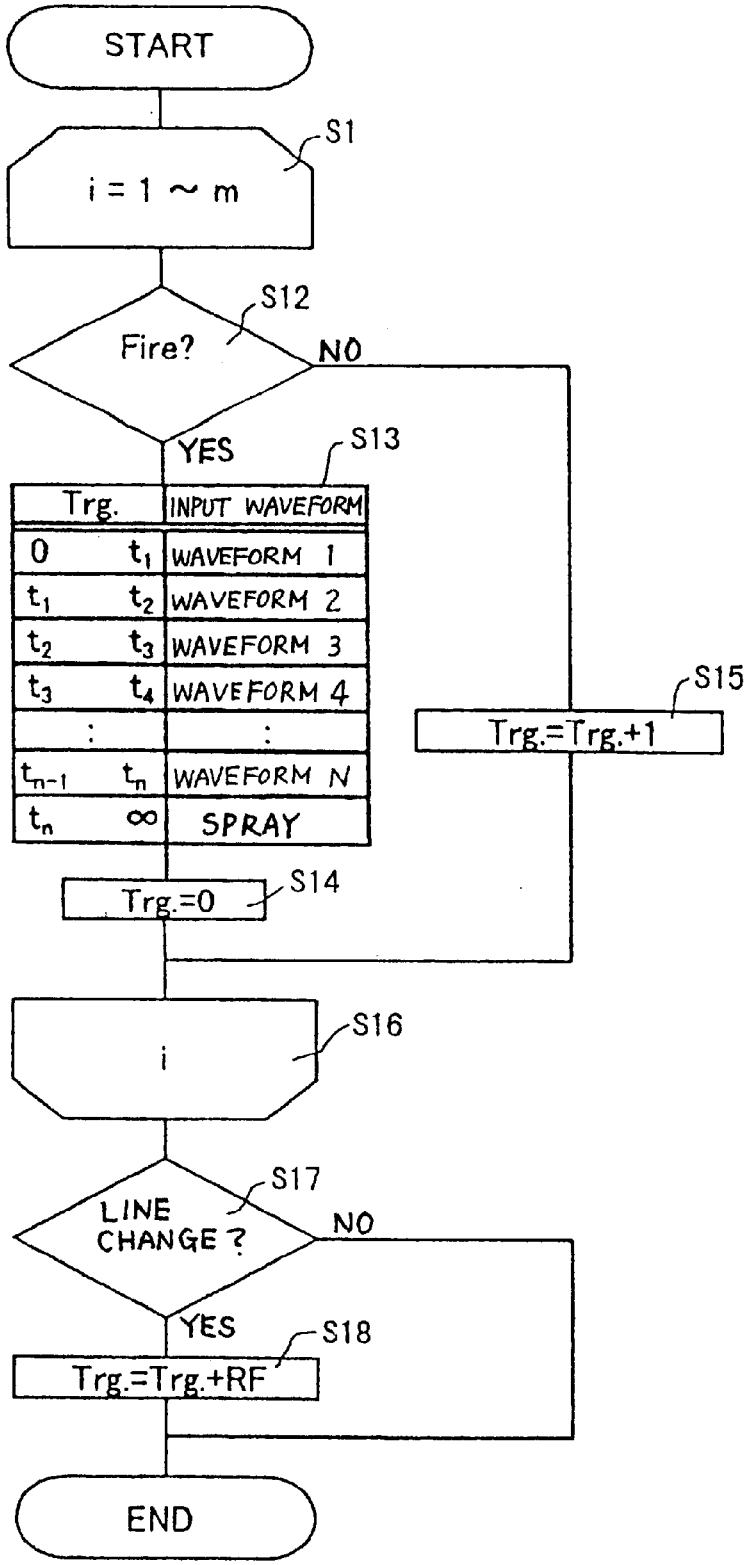
FIG. 17 is a flowchart showing an operation of a CPU of the drive control circuit to select a waveform of a drive voltage signal applied to a piezoelectric element of an inkjet head of the inkjet printing device according to the fourth preferred embodiment of the present invention.

FIG. 17 is a flowchart showing an operation of the CPU 81 of the drive control circuit to select a waveform of a drive voltage signal applied to a piezoelectric element of an inkjet head according to this embodiment.

Referring also to FIGS. 2 and 10 to 16, the operation of the CPU 81 will be desired hereinbelow.

Steps S1 and S16 represent that a series of processes between those steps is applied to all the nozzles i 1 to m.

At step S12, it is checked whether the subject nozzle is at the injection timing of an ink drop. If negative, the procedure goes to step S15 where a unit injection interval i.e. "1", is added to a flying interval (Trg.) of the subject nozzle.

On the other hand, if positive at step S12, the procedure goes to step S13 where a waveform of a drive voltage signal to be applied to a corresponding piezoelectric element is selected corresponding to the flying interval (Trg.) of the subject nozzle. If the flying interval (Trg.) of the subject nozzle exceeds a predetermined time, a spray process is selected to once return a corresponding inkjet head (having the subject nozzle) to a home position and then forcibly remove a sticky material adhering to a nozzle opening of the subject nozzle.

After the foregoing series of processes is executed relative to all the nozzles i 1 to m, the procedure goes to step S17 where it is checked whether the subject inkjet head is at the timing of line change if negative the procedure is ended.

On the other hand, if positive at step 17, procedure goes to step S18 where RF, i.e. a time required for line change, is added to the flying intervals (Trg,) of all the nozzles i–1 to m, and then is ended.

The waveform of the drive voltage signal selected by the CPU 81 for each of the nozzles is notified to the controller 82 so that a concrete digital waveform signal corresponding to the selected waveform for each nozzle is fed to the controller 82 from the waveform memory 83. Then, the controller 82 distributes the respective waveform signals to the corresponding piezoelectric elements $\mathbf{85}_1$, $\mathbf{85}_2$, . . . , $\mathbf{85}_n$ via the D/A converters $\mathbf{84}_1$, $\mathbf{84}_2$, . . . , $\mathbf{84}_n$.

It may also he arranged that the waveform memory 83 is provided in a given region set in the CPU 81.

According to the foregoing preferred embodiments of the present invention, the accuracy of ink drop hit positions and ink dot sizes on the print medium can be improved in the halftone printing. Specifically it can solve the conventional problem that due to a difference in size of ink drops a change in drive frequency, flying of a satellite drop as used by meniscus vibration after an injection of an ink drop or increment of a flying interval of an ink drop to be injected via the nozzle an ink drop hits upon the print medium at a position dislocated from an expected position or the dot size changes. As a result, the disorder of the output image can be prevented to enhance the printing quality.

Further, since the injection of all the ink drops is carried out by the single-pass technique, the printing speed is highly increased as compared with the conventional multi-pass printing.

While the present invention has been described in terms of the preferred embodiments the invention is not to be limited thereto, but can be embodied in various ways without departing from the principle of the invention as defined in the appended claims.

What is claimed is:

1. An inkjet printing method wherein an ink drop is injected via a nozzle by changing drive voltages applied to a piezoelectric element to reduce the volume of a pressure chamber filled with ink, so that the injected ink drop hits upon a print medium to carry out printing, the inkjet printing method comprising:

changing upon injecting the ink drop via the nozzle, an injection timing of the ink drop corresponding to a drive frequency of said drive voltages using a predetermined rule which is prestored.

2. The inkjet priming method according to claim 1, wherein said prestored predetermined rule comprises a table defined in terms of drive frequencies of the drive voltages and optimum injection timings of the ink drop corresponding to the drive frequencies.

3. An inkjet printing method wherein an ink drop is injected via a nozzle by changing drive voltages applied to a piezoelectric element to reduce the volume of a pressure chamber of an inkjet head filled with ink, so that the injected ink drop hits upon a print medium to carry out printing, the inkjet printing method comprising:

controlling the inkjet head upon injecting the ink drop via the nozzle such that $T3 \leqq Tc$ or $(T2+T3) \leqq Tc$, wherein T2 represents a time for rapidly contracting the pressure chamber after T1 representing a time for expanding the pressure chamber, T3 represents time for holding the contracted state of the pressure chamber or further contracting the pressure chamber gradually, T4 represents a time or restoring the pressure chamber to an initial state, and Tc represents a period given by 1/Helmholtz resonance frequency of the pressure chamber.

4. An ink jet printing method wherein an ink drop is injected via a nozzle by changing drive voltages applied to a piezoelectric element to reduce the volume of a pressure chamber tilled with ink, so that the injected ink drop hits upon a print medium to carry out printing, the inkjet printing method comprising:

determining a waveform of said drive voltages corresponding to a flying interval of the ink drop using a predetermined rule which is prestored, said flying interval being defined as a time from an injection of an ink drop to an injection of a subsequent ink drop.

5. The inkjet printing method according to claim 4, wherein the waveform of said drive voltages includes two continuous rising portions following a descending portion and having different inclinations, and wave heights of said two rising portions are defined in said prestored predetermined rule.

6. The inkjet printing method according to claim 4, wherein said prestored predetermined rule comprises a table defined in terms of flying intervals of ink drops to be injected via the nozzle and optimum waveforms of drive voltages corresponding to said flying intervals.

7. An inkjet printing device wherein an ink drop is injected via a nozzle by changing drive voltages applied to a piezoelectric element to reduce the volume of a pressure chamber filled with ink, so that the injected ink drop hits upon a print medium to carry out printing, the inkjet printing device characterized by:

changing, upon injecting the ink drop via the nozzle, an injection timing of the ink drop corresponding to a drive frequency of said drive voltages using a predetermined rule which is prestored.

8. The inkjet printing device according to claim 7, wherein said prestored predetermined rule comprises a table defined in terms of drive frequencies of the drive voltages and optimum injection timings of the ink crop corresponding to the drive frequencies.

9. An inkjet printing device wherein an ink drop is injected via a nozzle by changing drive voltages applied to a piezoelectric element to reduce the volume of a pressure chamber of an inkjet head filled with ink, so that the injected ink drop hits upon a print medium to carry out printing the inkjet printing device characterized by:

controlling the inkjet head upon injecting the ink drop via the nozzle such that $T3 < Tc$ or $(T2+T3) \leqq Tc$, wherein T2 represents a time for rapidly contracting the pressure chamber after T1 representing a time for expanding the pressure chamber, T3 represents a lime for holding the contracted state of the pressure chamber or further contracting the pressure chamber gradually, T4 represents a time for restoring the pressure chamber to an initial state, and Tc represents a period given by 1/Helmholtz resonance frequency of the pressure chamber.

10. An inkjet printing device wherein an ink drop is injected via a nozzle by changing drive voltages applied to a piezoelectric element to reduce the volume of a pressure chamber filled with ink, so that the injected ink drop hits upon a print medium to carry out printing, the inkjet printing device characterized by:

determining a waveform of said drive voltages corresponding to a flying interval of the ink drop using a predetermined rule which is prestored, said flying interval being defined as a time from an injection of an ink drop to an injection of a subsequent ink drop.

11. The inkjet printing device according to claim 10, wherein the waveform of said drive voltages includes two continuous using portions following a descending portion and having different inclinations, and wave heights of said two rising portions and defined in said prestored predetermined rule.

12. The inkjet printing device according to claim 10, wherein said prestored predetermined rule comprises a table defined in terms of flying intervals of ink drops to be injected via the nozzle and optimum waveforms of drive voltages corresponding to said flying intervals.

* * * * *